United States Patent [19]

Eckhardt

[11] 4,096,604

[45] Jun. 27, 1978

[54] HINGE MECHANISM

[75] Inventor: Friedhelm Eckhardt, Burbach-Niederdresselndorf, Germany

[73] Assignee: U.S. Philips Corporation, New York, N.Y.

[21] Appl. No.: 709,333

[22] Filed: Jul. 28, 1976

[30] Foreign Application Priority Data

Aug. 2, 1975 Germany ..... 2534652

[51] Int. Cl.[2] ..... A47B 95/02

[52] U.S. Cl. ..... 16/128.1; 74/53; 74/96

[58] Field of Search ..... 74/57, 53, 96; 16/128.1

[56] References Cited

U.S. PATENT DOCUMENTS 2,956,303 10/1960 Fiedler ..... 16/128.1

FOREIGN PATENT DOCUMENTS 2,345,452 3/1975 Germany ..... 16/128.1

*Primary Examiner*—Allan D. Herrmann
*Assistant Examiner*—Wesley S. Ratliff, Jr.
*Attorney, Agent, or Firm*—Frank R. Trifari; Rolf E. Schneider

[57] ABSTRACT

A hinge mechanism for hingeably connecting a lid to a housing comprising at least one pair of pivotably interconnected links coupled to the lid and the housing, respectively, and a connecting link provided with a pin slideable in a curved slot provided in a guide link pivotable simultaneously in a fixed relationship with the interconnected link coupled to the housing.

3 Claims, 2 Drawing Figures

HINGE MECHANISM

This invention relates to a hinge mechanism comprising rods or links coupled on one side to a stationary housing and on the other side to a lid hingeable relative to the housing and pivotable about a hinge spindle which moves relative to the housing during the opening and closing, the said lid being coupled to the housing by way of at least one pair of rods pivotably connected to each other.

In a known hinge mechanism of the kind set forth (from the book "Getrieblehre", Vol. I, 1963, pages 163/164, FIGS. 6.15 and 6.16, by Kurt Hein) the hinge movement of the lid commences simultaneously with the opening of the lid. This has the drawback that overlaps between lid and housing are not possible, so that propersealing between lid and housing can be achieved only when special steps are taken. Such a proper sealing between lid and housng is desirable, for example, in data processing machines in which magnetic tape stores or disc stores must be isolated as well as possible from the surroundings after use.

The invention has for its object to provide a hinge mechanism which enables overlap between housing and lid whereby proper sealing between housing and lid is achieved.

To this end, the hinge mechanism in accordance with the invention is characterized in that one of the rods of the said pair is provided with a guide pivotable simultaneously with this rod in a fixed mutual position and including a curved slot in which a pin is slidable, such pin being arranged on a connection rod which is pivotably connected to the housing near one end, its other end being pivotably connected to the lid.

Figure 1:
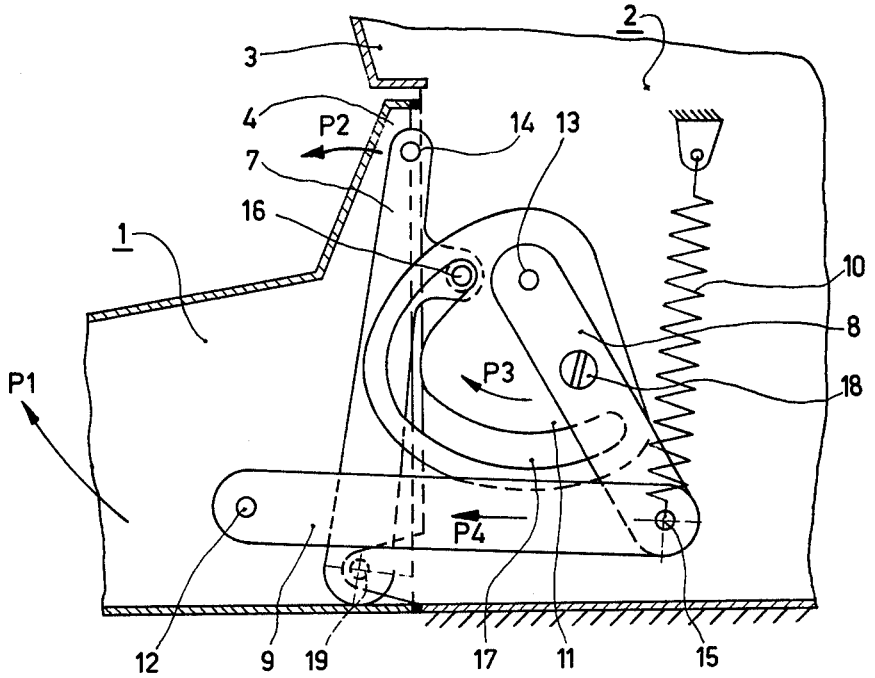
Figure 2:
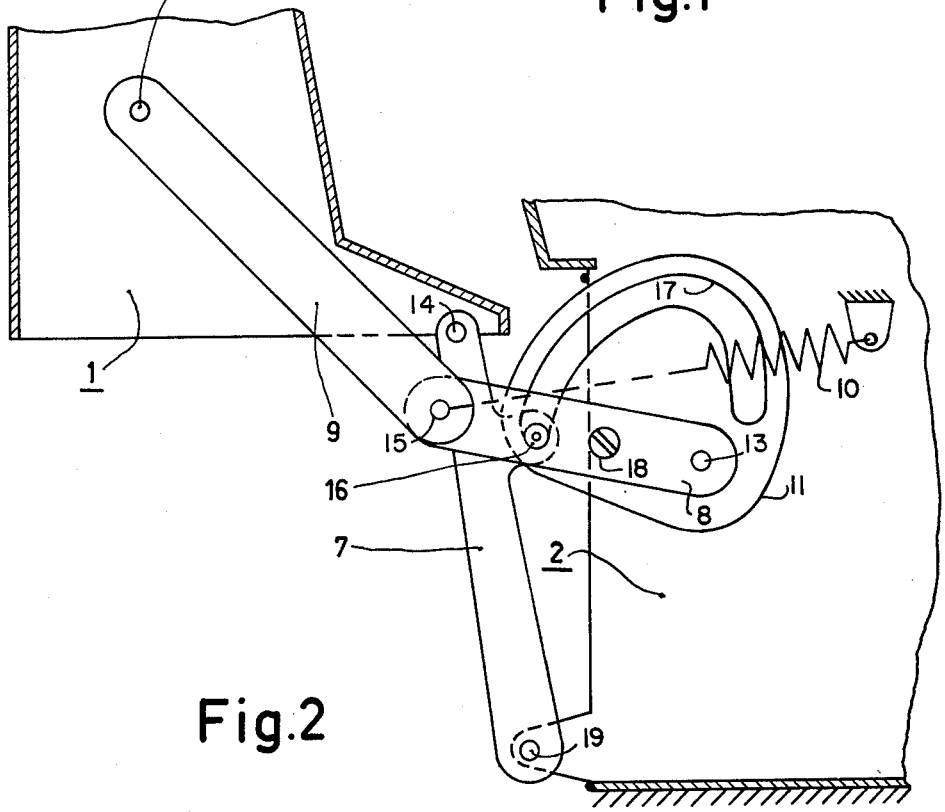

The invention will be described in detail hereinafter with reference to the accompanying drawing, in which FIG. 1 shows a preferred embodiment of a hinge mechanism in the closed condition of the lid, and FIG. 2 shows the hinge mechanism of FIG. 1 in the open condition of the lid.

The stationary housing 2 shown in FIGS. 1 and 2 can be closed by a lid 1 and is intended to accommodate a data processing machine — such as a bookkeeping machine — which is not shown for the sake of clarity. A portion 3 of the housing 2 connects with little play with an upright angular portion 4 of the lid 1.

The lid 1 is connected to the housing 2 by way of a pair of rods 8 and 9 which are pivotably interconnected at the point 15. The rod 8 is pivotable about a shaft 13 which is rigidly connected to the housing 2, and the rod 9 is pivotable about a shaft 12 which is connected to the lid 1. The lid 1 is also connected to the housing 2 via a connection rod 7 which is pivotable near one free end about a shaft 14 connected to the lid 1 and near its other free end about a shaft 19 connected to the housing 2. The connection rod 7 includes a pin 16 which is slidably guided in a curved slot 17 in a plate-like guide 11. The guide 11 is pivotable, simultaneously with the rod 8 about the stationary shaft 13 and is connected to the rod 8 for this purpose by means of a screw 18. The point 15 of the rods 8 and 9 is connected to the housing 2 by way of a tensile spring 10. The pivot tensile spring 10 serves as a so-termed "dead center spring".

The upper portion of the slot 17 of the smoothly operating preferred embodiment of the hinge mechanism shown in the drawing is circular. The center of the relevant circle is situated near the point 15 on the connecting line between the point 15 and the pin 16 in the situation shown in FIG. 1. The portion of the slot 17 which is situated at the right is also circular. The center of the relevant circule is the stationary shaft 13. The two circular portions of the slot 17 gradually change from one into the other.

The lid 1 is opened by pulling the lid approximately in the direction of the arrow P1. The shaft 14, the guide 11 and the rod 9 then move in the direction of the arrows P2, P3 and P4, respectively. The drawing shows that initially a substantially translatory movement of the lid occurs, followed by a rotary movement. The translatory movement of the lid during the initial opening phase is substantially approximated in that a comparatively long length has been chosen for the connection rod 7. The spring 10 ensures that, after the dead center has been passed, the lid reaches the open position in an accelerated manner, less operating force then being required (see FIG. 2). Due to the translatory movement of the lid during the initial opening phase and the final closing phase, the mating portions 3 and 4 of housing and lid may have a shape which would give rise to undercutting in known hinge mechanisms with immediate rotation of the lid.

The shape of the slot 17 can be adapted to the shape of the mating portions of lid and housing, so that always the most suitable movement path of the lid is obtained.

Even though the hinge mechanism has been described with reference to a unilateral construction, it will be obvious that a symmetrical construction comprising identical systems on each side of the lid is to be preferred. A unilateral construction has been shown merely for the sake of simplicity.

What is claimed is:

1. A hinge mechanism coupled on one side to a stationary housing and on the other side to a lid hingeable relative to the housing, which comprises a hinge spindle translatorily movable relative to the housing during opening and closing of the lid and pivotably carried by said lid, at least one pair of links pivotably connected to each other, the free end of one of said links being pivotably connected to said lid and the free end of the other of said links being pivotably connected to said housing, a guide affixed to the other link and pivotable simultaneously with said other link in fixed relationship therewith about the pivotable connection of the latter to the housing, said guide being provided with a curved slot, and a pin slidable in said curved slot and arranged on a connecting link pivotably connected at one end to the housing, the other end of said connecting link being pivotably mounted on said hinge spindle.

2. A hinge mechanism according to claim 1, in which the slot in the guide has a circular initial portion whose center is situated near the pivotable connection of said pair of links and a circular end portion whose center is situated at the pivotable connection of said other link to said housing.

3. A hinge mechanism according to claim 1, in which a dead center spring extends between the pivotable connection of said pair of links and the housing.

* * * * *